US009700779B1

(12) United States Patent
Leal et al.

(10) Patent No.: US 9,700,779 B1
(45) Date of Patent: Jul. 11, 2017

(54) FOOTBALL THROWING APPARATUS

(71) Applicants: Jose Leal, Stow, MA (US); John Barletta, Southborough, MA (US)

(72) Inventors: Jose Leal, Stow, MA (US); John Barletta, Southborough, MA (US)

( * ) Notice: Subject to any disclaimer, the term of this patent is extended or adjusted under 35 U.S.C. 154(b) by 0 days.

(21) Appl. No.: 15/237,313

(22) Filed: Aug. 15, 2016

(51) Int. Cl.
*F41B 11/723* (2013.01)
*A63B 69/40* (2006.01)

(52) U.S. Cl.
CPC ..... *A63B 69/409* (2013.01); *F41B 11/723* (2013.01); *A63B 2243/007* (2013.01)

(58) Field of Classification Search
CPC ..... F41B 11/60; F41B 11/62; F41B 11/72; F41B 11/723; F41B 11/73; A63B 69/409
USPC ..... 124/60, 65, 69, 70, 71
See application file for complete search history.

(56) References Cited

U.S. PATENT DOCUMENTS 2,581,758 A * 1/1952 Galliano ..... F41B 11/00 124/75
2,634,717 A * 4/1953 Junkin ..... F41B 11/723 124/50
2,780,213 A * 2/1957 Colling ..... F41B 11/00 124/37
3,056,395 A * 10/1962 Merz ..... F41B 11/62 124/31
4,531,458 A * 7/1985 Saxby ..... F41B 11/62 102/430
5,187,323 A * 2/1993 Saxby ..... F42B 6/10 102/440
5,450,839 A * 9/1995 Nicolaevich ..... F41B 11/723 124/70
5,700,972 A * 12/1997 Saxby ..... F41B 11/62 102/440
5,706,795 A * 1/1998 Gerwig ..... F41H 13/0006 124/71
6,945,495 B1 * 9/2005 Lund ..... A63H 27/005 124/71
7,213,589 B2 * 5/2007 Eichner ..... F41B 11/62 124/73
8,256,406 B1 * 9/2012 Kirkpatrick ..... F41B 11/723 102/440
2005/0183710 A1 * 8/2005 Lapointe ..... F41B 11/00 124/65
2006/0225719 A1 * 10/2006 Leal ..... F41B 11/57 124/71
2010/0307472 A1 * 12/2010 Witzigreuter ..... F41B 11/723 124/69

(Continued)

*Primary Examiner* — Bret Hayes
*Assistant Examiner* — Derrick Morgan
(74) *Attorney, Agent, or Firm* — Joseph E. Funk

(57) ABSTRACT

A football throwing apparatus is described that utilizes air pressure to throw a football in a conventional spiral manner. How far the football can be thrown can be adjusted by an air pressure control. The football may be thrown immediately upon pressing a button, or it may be thrown after a predetermined period of time after the operation of a switch. The football throwing apparatus is initially charged with pressurized air in a first area and a second area. The button or switch causes the pressurized air in the first area to be immediately vented which creates a vacuum due to the pressurized air in the second area. The vacuum actuates a mechanical linkage that causes the pressurized air stored in the second area to be released and throw the football.

16 Claims, 8 Drawing Sheets

(56) References Cited

U.S. PATENT DOCUMENTS

| | | | | |
|---|---|---|---|---|
| 2013/0037012 | A1* | 2/2013 | Gaus | F41F 7/00<br>124/4 |
| 2015/0013656 | A1* | 1/2015 | Priestley | F42B 6/10<br>124/74 |
| 2015/0241165 | A1* | 8/2015 | Tippmann, Sr. | F41B 11/62<br>124/57 |
| 2015/0316345 | A1* | 11/2015 | Brahler, II | F41B 11/72<br>124/73 |

* cited by examiner

FOOTBALL THROWING APPARATUS

FIELD OF THE INVENTION

This invention relates to a sports ball throwing apparatus and more particularly to such an apparatus that throws a football.

BACKGROUND OF THE INVENTION

In the prior art there are numerous apparatus that are used for passing, throwing or launching footballs, sports balls and other projectiles such as model rockets. One version of such an apparatus is disclosed in U.S. Pat. No. 4,026,261 which describes an apparatus that employs two spaced, rotatably-driven, pneumatic-tired wheels that have their outer surfaces confronting each other and spaced apart a distance less than the maximum diameter of a football to be thrown. The wheels, when rotating, propel a football. The wheels are mounted in such a way that the planes in which they rotate can be independently varied.

Another apparatus for throwing footballs is disclosed in U.S. Pat. No. 4,723,532 which also utilizes spaced apart confronting surfaces of spinning wheels.

These prior art football passing apparatus are complex and expensive and meant mainly for use in professional football.

Yet another apparatus used for passing footballs is disclosed in U.S. Pat. No. 4,291,663. This football passing apparatus utilizes a spring that is located in a cylindrical, hollow tube. The spring is first extended and is then released to provide the force to propel a football. One end of the spring is connected to an upper end of the tube, and the other end of the spring is loose but connected to a platform that is mounted on and rides alongside the outside of the tube. To connect the platform to the spring internal to the tube there is an elongated narrow aperture though the wall of the hollow tube that extends in a helical fashion along a portion of the tube. The spring and platform are connected through this aperture. When the spring is extended the platform connected thereto is at the bottom of the helical, elongated aperture. A football having a coaxial cylindrical channel through its length is placed down over the exterior of the hollow tube to sit on the platform. When the stretched spring is released the platform travels up the tube in a spiral fashion along the helical aperture. The football sitting on top of the platform is thereby launched with a spiral spin. The one drawback to this football passing apparatus is that to throw a pass of twenty yards or so requires a spring that is so strong that it cannot practically be used by children. Thus, there is a need in the art for a football passing machine that is easy to use even by children.

SUMMARY OF THE INVENTION

The novel football throwing apparatus disclosed herein is only described with reference to a football and a way to provide longitudinal spin to the football.

The novel apparatus described and claimed herein uses internally stored compressed air to launch a football. By adjusting the level of air pressure of the air stored in the apparatus the football may be launched/thrown a short distance or a relatively long distance.

The football throwing apparatus has a chamber and a barrel in which the compressed air is primarily stored until utilized to launch a football. The football has a cavity in its rear end that is placed over a launching end of the barrel. The barrel is pointed in a direction and at an elevation at which it is desired to throw the football. When the compressed air is released the football on the end of the barrel is launched/thrown from the barrel in the chosen direction and elevation.

Upon the release of the football being manually initiated by operating one of two switches a small amount of the stored compressed air is rapidly vented and this creates a vacuum that moves mechanical components inside the football throwing apparatus to vent the major amount of the stored compressed air to launch/throw the football.

To prevent any items, other than the football provided with the throwing apparatus from being placed on the end of the barrel and being launched, a safety mechanism is provided in the wall of the barrel. The safety mechanism only permits compressed air to be stored inside the throwing apparatus when only the provided football is mounted on the barrel. More particularly, when the provided football is not positioned on the launching end of the barrel, the chamber and barrel of the throwing apparatus are not sealed by the safety mechanism and air pressure cannot build up in the barrel to launch anything. This safety mechanism provides a level of safety against misuse of the throwing apparatus.

To adjust the level of air pressure inside the barrel and chamber for launching the provided football mounted on the launching or throwing end of the barrel, a manually adjustable air pressure mechanism is provided. When compressed air inside the barrel and chamber of the throwing apparatus reaches a certain pressure level as determined by the manually adjustable pressure regulator, the football is ready to be thrown. With higher air pressure inside the barrel and chamber of the football throwing apparatus the further the football will be launched/thrown and visa versa. The air pressure mechanism may be fully manually adjustable over a range of pressures or may only have one, two or three fixed pressure levels.

When the barrel and chamber of the football throwing apparatus are pressurized to a level determined by the manually adjustable air pressure mechanism, the provided football is ready to be thrown by the throwing apparatus. Two modes of throwing/launching the football are provided. A manually operated first switch is provided that, when operated by the operator of the football throwing apparatus, immediately throws/launches the football. A second switch is provided that, when operated by the operator of the football throwing apparatus, commences the timing of a predetermined period at the end of which the football throwing apparatus releases the compressed air stored in the barrel and chamber to throw/launch the provided football mounted on the barrel of the football throwing apparatus.

To impart a spin to the football when it is thrown by the throwing apparatus other elements are utilized. On the outside wall of the barrel are helical, rifling grooves. These grooves start at the launching end of the barrel and go back along the barrel. Inside a cavity in the rear of the provided football are one or more protrusions. A protrusion sits in each of the barrel grooves when the football is placed on the end of the barrel to be thrown. When the football is thrown/launched the protrusions ride along the grooves as the football travels along and leaves the barrel. This imparts a spiral spin to the football. Such a spiral spin is desirable for a football as is known in the art.

DESCRIPTION OF THE DRAWINGS

The invention is best understood upon reading the following Detailed Description in conjunction with the drawing in which.

DETAILED DESCRIPTION

The football throwing apparatus 10 disclosed herein is only described with reference to a football 31. However, the apparatus 10 may be used with other modified sports balls that are to be thrown, and where spin on the ball may or may not be needed. The preferred embodiment of the invention described herein is used to only launch/throw football 31.

Figure 1:
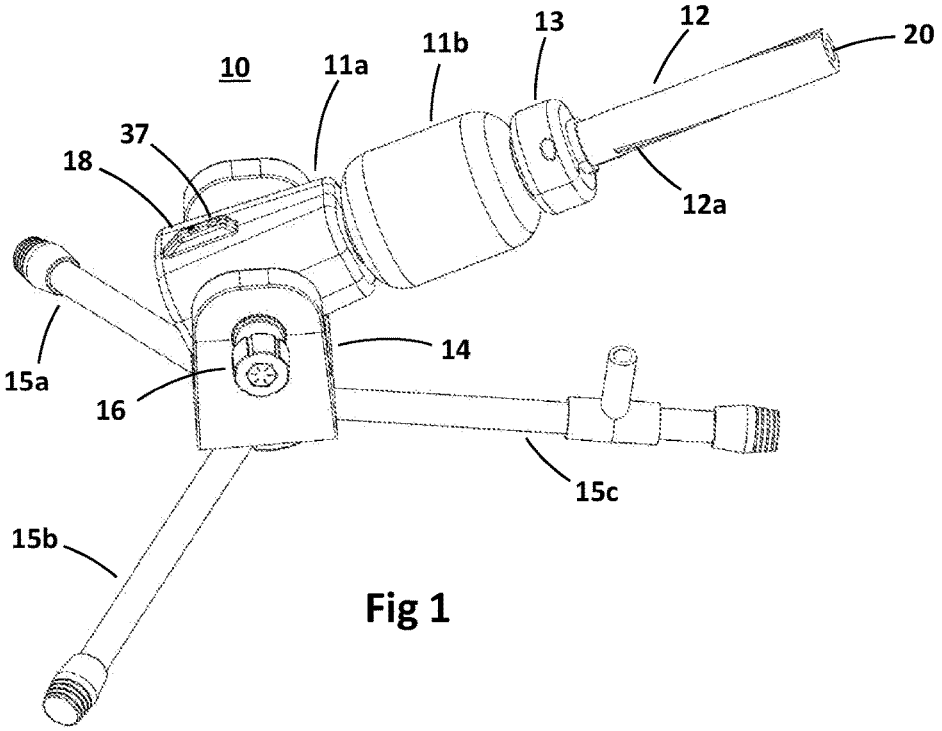
FIG. 1 is a right side elevation view of the football throwing apparatus showing the main body thereof, a helically grooved barrel with no football mounted thereon and showing a control for adjusting the air pressure for launching a football.
Figure 2:
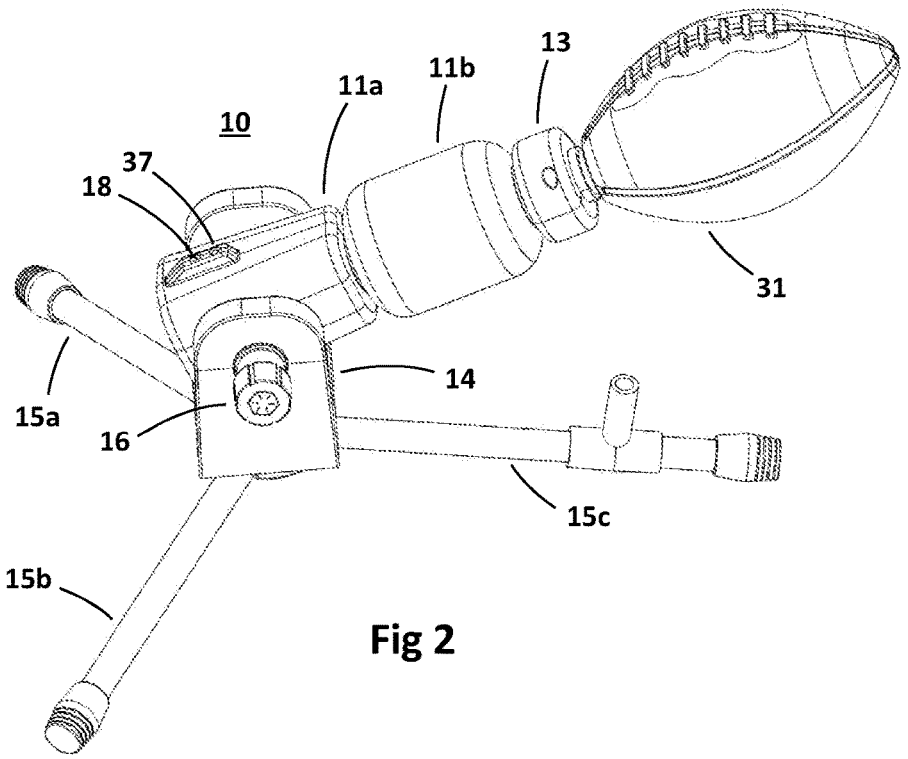
FIG. 2 is a right side elevation view of the football throwing apparatus with a football mounted on the helically grooved barrel.

In FIG. 1 is shown a right side elevation view of the novel football throwing apparatus 10. The basic elements making up apparatus 10 are shown in and introduced with reference to FIG. 1 and those elements are explained in more detail with reference to other Figures. Starting at the right of apparatus 10 there is a barrel 12 having external spiral grooves 12*a*, and barrel 12 is connected to an air pressure chamber 11*b* in an airtight manner by a U-clamp fastening means 13. In the claims complements 11*b* and 12 are referred to as a second enclosed chamber. Air pressure chamber 11*b* is fastened to main body 11*a*. The launching end 20 of barrel 12 is where the provided football 31 is mounted as shown in FIG. 2.

Combined elements 11*a*, 11*b* and 12 are mounted in a frame comprising a "U" shaped member 14 that is rotatably mounted on legs 15*a,b,c*. Member 14 is rotated about the top of legs 15*a,b,c* to aim a football 31 (FIG. 2) in the direction it will be launched/thrown, and elements 11*a*, 11*b* and 12 are pivoted vertically within "U" shaped member 14 to set the angle of elevation at which football 31 will be thrown.

Compressed air is inserted into football throwing apparatus 10 via a Schrader valve 17 on the left side of apparatus 10 (shown in FIGS. 3 and 4), is stored in elements 11*a*, 11*b* and 12 and is used to launch the special football 31 off barrel 12. This is described in more detail further in this Detailed Description. The pressure of the compressed air stored in elements 11*a*, 11*b* and 12 is set utilizing a manually adjustable air pressure control 16 protruding from the right side of main body 11*a* and extending through a right side wall of U" shaped member 14 as shown in FIGS. 1, 2 & 5. By adjusting the pressure of the stored compressed air a football 31 may be launched a short distance or a relatively long distance. As air is pumped into the football throwing apparatus 10 via the Schrader valve 17 (FIGS. 3 & 4), when the air pressure level set using air pressure control 16 is exceeded, an exhaust valve is opened to vent any more compressed air being input and thereby prevent a further increase in the air pressure of the stored air. The air pressure mechanism may be fully manually adjustable over a range of pressures or may only have one, two or three fixed pressure levels.

Main body 11*a* also includes: (1) a button 19 on the rear of main body 11*a* (not shown in FIGS. 1 and 2 but shown in FIG. 5) for manually releasing stored compressed air to throw football 31 immediately after button 19 is depressed, and (2) an on/off electrical switch 18 that is also manually actuated to cause football throwing apparatus 10 to launch a football 31 a predetermined time after switch 18 is operated to an ON state, and (3) an LED 37 that indicates when switch 18 is in its ON state (see FIG. 11). The aforementioned time delay permits the user of football throwing apparatus 10 to run ahead of apparatus 10 and catch a football 31 after it is thrown/launched by apparatus 10. In the embodiment of the invention described herein a fixed time delay is described, but the design may be easily changed to modify the timing and provide other fixed time delays, or to provide a variable time delay.

FIG. 2 shows a right side elevation view of the football throwing apparatus 10 with a special football 31 mounted on the helically grooved barrel 12. The description of the elements shown in FIG. 2 are the same as for FIG. 1 and are not repeated here. In the outer surface of barrel 12 there is a helical groove 12*a* (see FIG. 1) that is used to impart a longitudinal spin to football 31 mounted on barrel 12 as it is launched from barrel 12. As shown in and described with reference to FIG. 10 there is a coaxial cylindrical channel 34 inside the base of football 31 into which the end 20 of barrel 12 is inserted when mounting the football 31 on barrel 12 as shown in FIG. 2. In doing so protrusion 33 (FIG. 10) on the inside wall of channel 34 is inserted onto groove 12*a* in the outside wall of barrel 12 and protrusion 33 rides down the groove 12*a* to the end of barrel 12 nearest air chamber 11*b*.

There is a mechanical safety mechanism created by the interaction between grooved barrel 12 and special football 31 when the football 31 is mounted on the barrel 12 that only allows air pressure to build up in barrel 12 and chamber 11*b* when football 31 is fully mounted on barrel 12. This safety mechanism is element 32 (32*a* and 32*b* in FIGS. 11 A-C) and is shown in and described in detail further in this Detailed Description with reference to FIGS. 6A & 6B and FIGS. 11 A-C.

Figure 3:
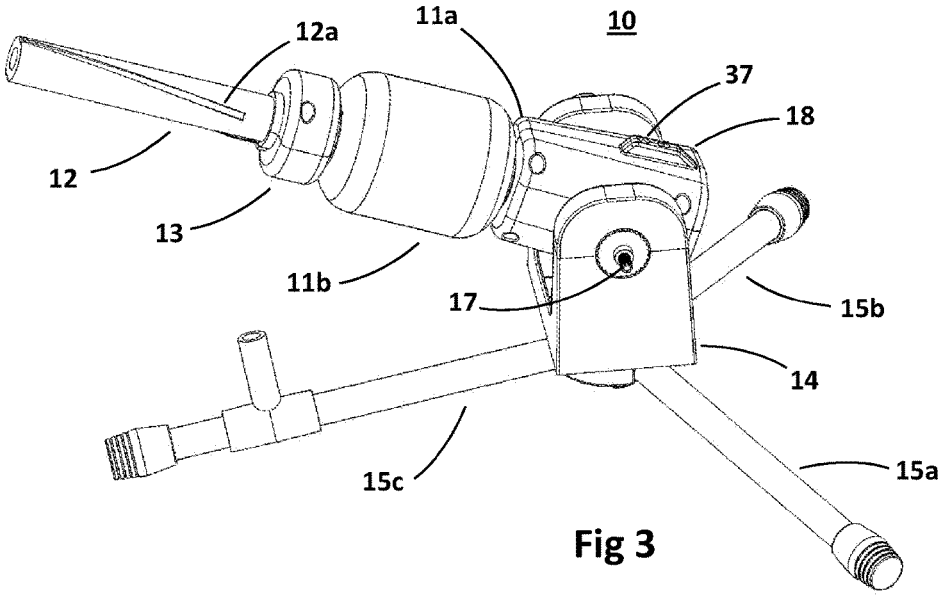
FIG. 3 is a left side elevation view of the football throwing apparatus showing the grooved barrel for applying a longitudinal spin to a football when it is thrown and a Schrader valve for connecting an air pump to the football throwing apparatus.

In FIG. 3 is shown a left side elevation view of the novel football throwing apparatus 10. Helical groove 12*a* in the outside wall of barrel 12 is best seen in this Figure. The description of elements 11*a*, 11*b* and 12 shown in FIG. 3 are the same as for FIGS. 1 and 2, except for Schrader valve 17, and their description is not repeated here. Schrader valve 17 exits main body 11*a* and passes through the left side wall of "U" shaped frame 14 as shown. A manually operated hand air pump (not shown) or an electrical air pump (not shown) are connected to Schrader valve 17 to pump air into football throwing apparatus 10 and build up air pressure inside barrel 12, chamber 11*b* and main body 11*a* to a pressure level as manually set using air pressure control knob 16 extending through the right side of frame 14 as shown in and previously described with reference to FIGS. 1 and 2.

Figure 4:
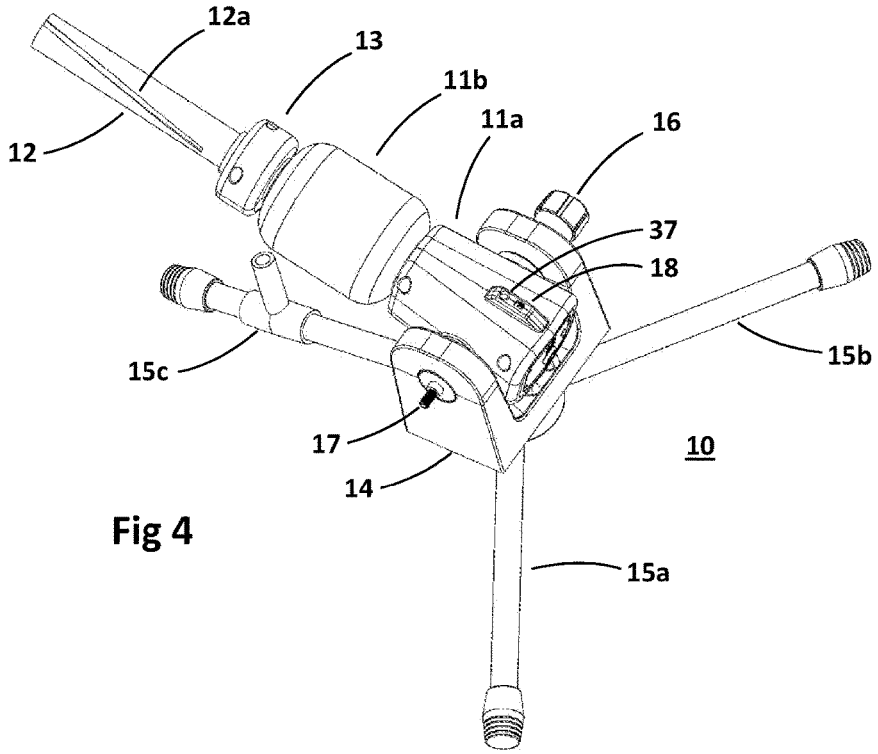
FIG. 4 is a rear elevation view showing the air pressure adjustment, the Schrader valve and a switch for turning on electrical power to the apparatus.
Figure 5:
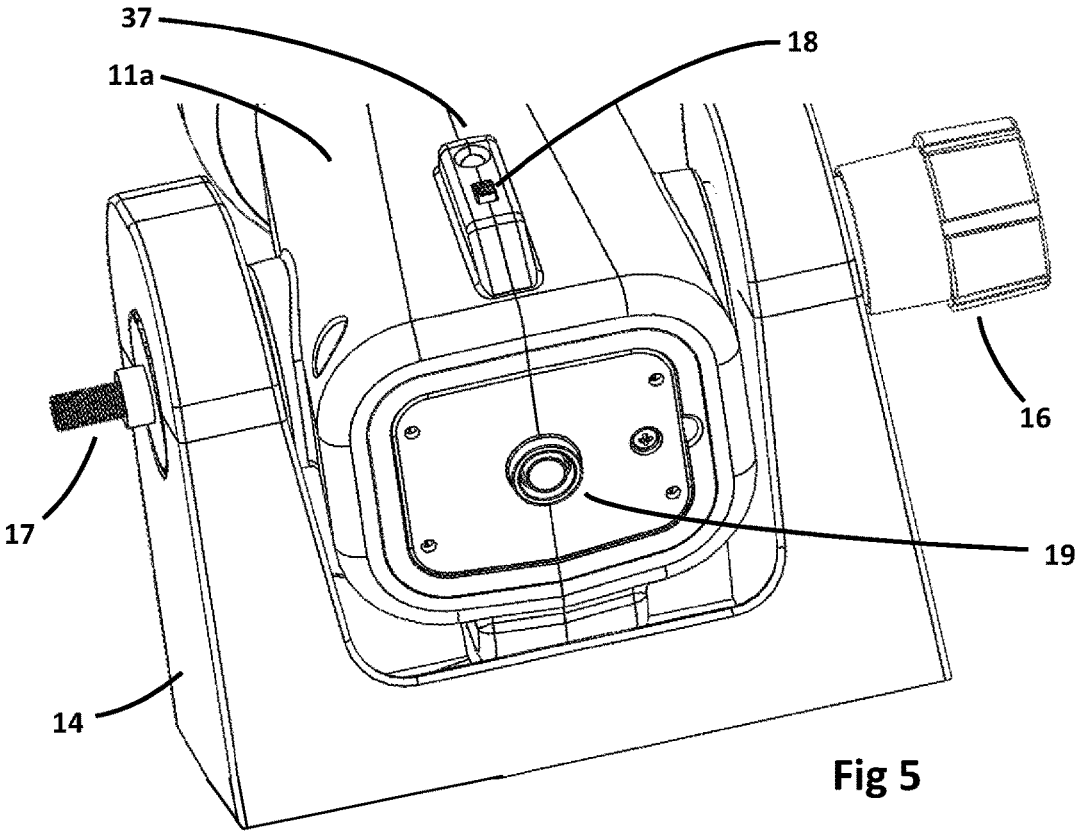
FIG. 5 is a rear elevation view of the main body of the football throwing apparatus showing an electrical power on/off power switch which is also used to throw a football after a short time interval, and a button that is manually operated to immediately throw/launch a football mounted on the barrel.

In FIG. 4 is shown a left, rear elevation view of football throwing apparatus 10 showing the air pressure adjustment 16, the Schrader valve 17, switch 18 for turning on electrical power which causes a predetermined time delay in throwing/launching a football 31 from football throwing apparatus 10, and an LED 37 which is lit to indicate when switch 18 is in its ON state. Other elements have been previously described with reference to FIGS. 1-3 so their description is not repeated here.

In FIG. 5 is shown a rear elevation view of football throwing apparatus 10. FIG. 5 shows electrical power on/off switch 18 mounted on the top rear of main body 11*a* which is actuated to its ON state to cause football 31 mounted on barrel 12 to be thrown/launched off barrel 12 a known time interval after switch 18 is actuated. Also shown is an LED 37 which is lit when switch 18 is in its operated or ON state. There is also a button 19 on the rear of main body 11*a* that is manually pushed to immediately throw a football 31 mounted on barrel 12, as shown in FIG. 2, with whatever air pressure is built up inside elements 11*a*, 11*b* and 12 at the moment button 19 is pressed, with maximum air pressure being set by air pressure adjustment 16. Air pressure adjustment 16 and Schrader valve 17 protrude from main body 11*a* and extend through the sidewalls of bracket 14 as shown and these elements have been previously described so their description is not repeated here.

Figure 6A:
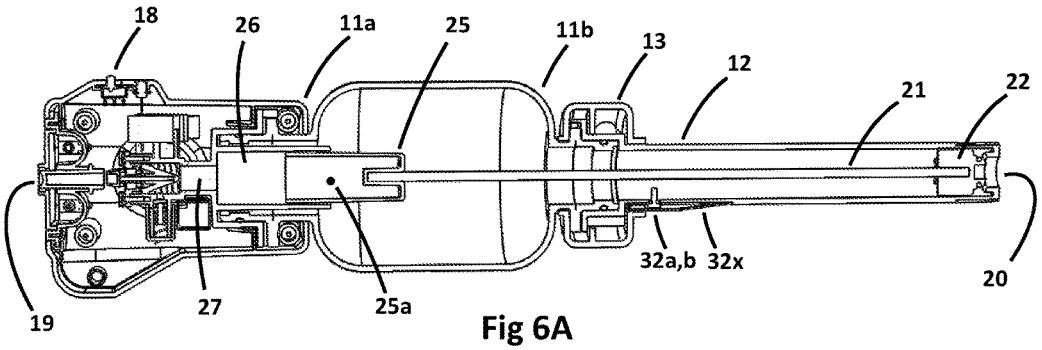
FIG. 6A is a side cutaway view of the football throwing apparatus charged with compressed air and ready to throw a football (not shown) mounted on the barrel as shown in FIG. 2.

FIG. 6A is a side cutaway view of the football throwing apparatus 10 charged with compressed air and ready to throw a football 31 (football not shown in FIG. 6A but shown in FIG. 2) mounted on barrel 12. As previously described, main body 11*a* is connected to air pressure chamber 11*b* which is fastened to barrel 12 by a U-clamp fastening means 13 in an airtight manner. Pressurized air input via the Schrader valve 17 on the left side of main body 11*a* (not shown in FIG. 6A but shown in FIG. 5) is stored inside components 11*a*, 11*b* and 12 only after a football 31 is mounted on barrel 12 as described elsewhere herein. Other components on or inside main body 11*a* are shown and described with reference to FIGS. 8, 9 and 11.

Figure 6B:
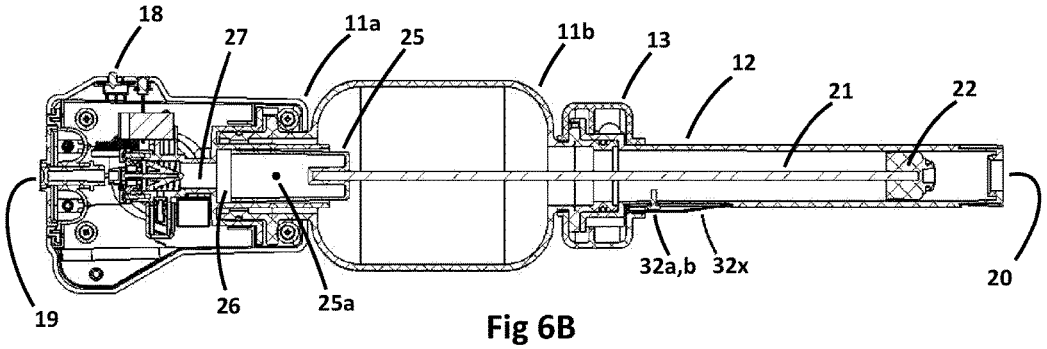
FIG. 6B is a side cutaway view of the football throwing apparatus immediately after a football mounted on the barrel has been launched as shown in FIG. 1.

In FIGS. 6A and 6B are shown a safety mechanism 32*a,b* and 32*x* mounted on and through the wall of barrel 12. I The safety mechanism is shown in and described in more detail in reference to FIGS. 11A, 11B and 11C. This safety mechanism basically comprises elements 32*a*&*b* and 32*x* which are respectively mounted through a hole through the barrel wall and on the surface of barrel 12 at the bottom rear end of barrel 12 as shown.

The elements inside main body 11*a* in FIGS. 6A and 6B are better shown and described with reference to FIGS. 8 and 9. Briefly, manually operated on/off electrical power switch 18 on the top of main body 11*a* is operated to its ON state to supply electrical power to a motor 35 (FIG. 9) to initiate an operational sequence of mechanical elements that causes football 31 to be thrown/propelled off the end of barrel 12 after a time delay. This permits a person who operates switch 18 to run out in front of football passing apparatus 10 to catch the football 31 when it is launched after the predetermined time delay. To provide a visual indication to the operator of football tossing apparatus 10 that switch 18 is operated an LED 37 mounted adjacent to switch 18 is lit. This is also shown in and described with reference to the electrical block diagram shown in FIG. 12. Alternatively, electric motor 35 could be replaced by a wind up spring and gear mechanism to accomplish the same purpose of providing a time delay in the launch of the football.

For the alternate, no time delay operation of football passing apparatus 10, after air pressure has built up inside main body 11*a*, chamber 11*b* and barrel 12, when button 19 on the rear of main body 11*a* is manually depressed it physically moves other elements inside main body 11*a* to cause a football 31 to be immediately thrown/launched off the end of barrel 12. This alternate operation is best shown in and described with reference to FIGS. 7 and 9.

FIG. 6A shows a slidable piston 25 with the left end of a rod 21 connected thereto, and the right end of rod 21 is connected to a sealing guide 22. Guide 22 is used to seal the open end 20 of barrel 12 so air pressure can build up, as is better shown in and described with reference to FIG. 7. Components 25, 21 and 22 are shown positioned almost all the way to the right where a sealing ring 23 (see FIG. 7) around the tip of sealing guide 22 is positioned within cylindrical protrusion 24 at the end barrel 12 to seal the open end 20 of barrel 12. Components 25, 21 and 22 are in the "closed", sealed position when pressurized air is input to football launching apparatus 10 and pushes these components all the way to the right to create the air tight seal by pushing "O" ring 23 on the front end of sealing guide 22 into cylindrical protrusion 24 at the end of barrel 12. Pressurized air being input to football throwing apparatus 10 via the Schrader valve 17 (See FIGS. 3&4) is then stored in components 11*a*, 11*b* and 12.

The position of "O" ring 23 on the front end of sealing guide 22 and the depth of cylindrical protrusion 24 in which the "O" ring sits provide additional security against misuse of the invention. Someone may tape over the hole through the rear underside of barrel 1 in which "T" shaped element sits to prevent air from escaping through this hole when no football is mounted on barrel 12, and then push a marble into opening 20 in the outer end of barrel 12. When they do this the marble pushes against the tip of sealing guide 22 and pushes it back inside barrel 12 enough to break the air pressure seal created by "O" ring 23. This bleeds any air pressure inside barrel 12 and air pressure chamber 11*b*.

In FIG. 6A it should be noted that there is a small hole 25*a* through the sidewall of hollow based piston 25. As shown hole 25*a* is positioned just beyond the right hand end of piston chamber 26. It is in this position when the open end 20 of barrel 12 is sealed and pressurized air is input to and stored in components 11*a*, 11*b* and 12 via Schrader valve 17. As pressurized air is being input to main body 11*a* via Schrader valve 17 (FIG. 5) the air enters connecting chamber 27 and flows to the right through piston chamber 26 into the hollow base of piston 25, through hole 25*a* through the sidewall of piston 25 into chamber 11*b*, and then into the interior 12*a* of barrel 12. In the claims chambers 26 and 27, and the hollow base of piston 25 are referred to as a first enclosed chamber.

FIG. 6B is a side cutaway view of the football throwing apparatus 10 immediately after a football 31 mounted on barrel 12 (FIG. 2) has been launched, and before apparatus 10 is put into use. After the football 31 has been launched off the end of barrel 12 components 25, 21 and 22 are positioned to the left, as shown, in a retracted position where piston 25 is positioned inside of piston chamber 26 and sealing guide 22 is retracted from the open end 20 of barrel 12. When initially retracted, pressurized air stored inside main body 11*b* and barrel 12 escapes around slots 22*a* of sealing guide 22 (see FIG. 7) and out of the open end 20 of barrel 31 into the hollow base of a football 31 (not shown) to launch the football. In this retracted position small hole 25*a* through the sidewall of hollow base piston 25 is positioned against the inside wall of piston chamber 26 and a relatively good air seal is created. This retraction operation is described elsewhere in this Detail Description.

When it is desired to launch a football 31 using football launching apparatus 10, a football 31 is positioned on barrel 12 as shown in FIG. 2. Football 31 causes elements 32*a,b* and 32*x* to seal barrel 12 as previously described. Pressurized air being input to main body 11*a* via the Schrader valve 17 (FIG. 5) enters connecting chamber 27 and flows to the right through piston chamber 26 into the hollow base of piston 25. With hole 25*a* being positioned against the interior sidewall of piston chamber 26, as shown in FIG. 6B, the pressurized air pushes the connected combination of piston 25, rod 21 and sealing guide 22 fully to the right and the open end 20 of barrel 12 is sealed by sealing guide 22 and its O-ring 23 entering cylindrical protrusion 24 (shown in and described with reference to FIG. 7). When elements 25, 21 and 22 are pushed fully to the right small hole 25*a* is then positioned just to the right end of piston chamber 26 and pressurized air being input to the system, as previously described, flows readily through hole 25*a* into chamber 11*b* and the interior 12*a* of barrel 12 to store pressurized air inside elements 11*a*, 11*b* and 12.

After football launching apparatus 10 is pressurized with air as previously described with reference to FIG. 6A, apparatus 10 is triggered to launch a football 31 mounted on barrel 12 in one of the following two ways. Either switch 18 on the top of main body 11*a* is operated to its ON state and the previously mentioned time period to launch a football 31 times out or, alternatively, button 19 on the rear of main body 11*a* is manually pressed and football 31 is immediately launched from the end of barrel 12. With either operation an airtight seal to the left of connecting chamber 27 in FIG. 6A is momentarily opened by element 29 (FIG. 8) and this immediately vents only the pressurized air stored inside connecting chamber 27, piston chamber 26 and the hollow base of piston 25 to outside of football launching apparatus 10. The rapid evacuation of this pressurized air creates a vacuum which pulls piston 25 to the left, as shown in FIG. 6B. Since piston 25 is connected to rod 21 and sealing guide 22, guide 22 is also pulled to the left and the airtight seal of its "O" ring created with cylindrical protrusion 24 of barrel outlet 20 is opened. This rapidly releases the compressed air stored inside chamber 11*b* and barrel 12 outside the open end 20 of barrel 12 and thereby launches football 31.

Although hole 25*a* is positioned just to the right end of piston chamber 26 (FIG. 6A) at the moment of launch the small size of hole 25*a* only permits a very small amount of the pressurized air stored inside air pressure chamber 11*b* and barrel 12 to pass through hole 25*a* toward main body 11*a* to be vented. After football 31 has been launched, as just described, air pressure must again be built up inside elements 25, 26, 27, 11*b* and 12 in preparation to again launch a football 31.

Figure 7:
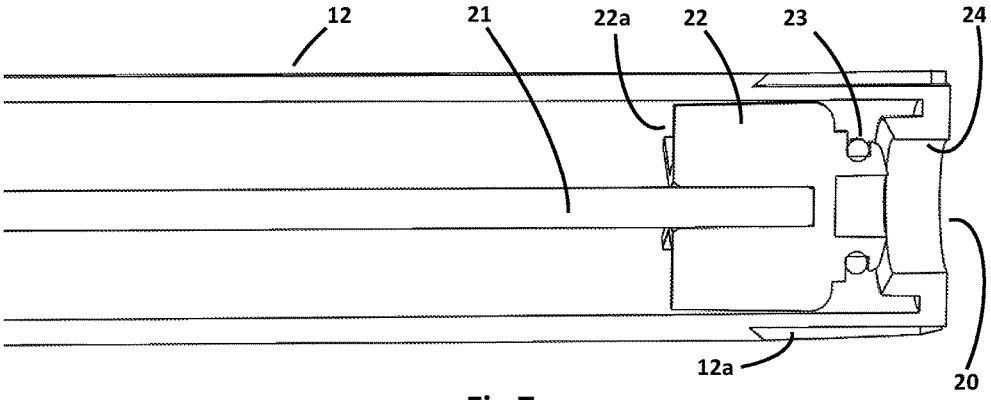
FIG. 7 is a side cutaway, blow up view of the interior of the launching end of the barrel of the football throwing apparatus when no air pressure has been built up in the barrel.

FIG. 7 shows a side cutaway view of the launching end of barrel 12 just before O-ring seal 23 on the nose end of guide 22 passes into cylindrical protrusion 24 to create an airtight seal there with. There is a barrel end opening 20 through which stored compressed air stored in chamber 11*b* and barrel 12 is expelled to launch football 31 (not for shown in FIG. 7 but shown in FIG. 2) off the end of barrel 12. There is a small cylindrical protrusion 24 that extends inside barrel 12 and cooperates with O-ring seal 23 mounted on the nose end of guide 22 to seal compressed air inside of apparatus 10 as seal 23 on the nose end of guide 22 is pushed inside cylindrical protrusion 24 under the influence of air pressure building up inside apparatus 10. O-ring seal 23 seals against the inside wall of cylindrical protrusion 24. Guide 22 is connected to the outer end of rod 21 which in turn is connected to piston 25 which moves to the right out of piston chamber 26 as air pressure increases. This allows air pressure to build up within barrel 12, chamber 11*b* and main body 11*a* as previously described.

As previously described with reference to FIGS. 6B and 7, an operating air pump (not shown) connected to Schrader valve 17 (FIGS. 3 and 4) on the left side of apparatus 10 causes air pressure to initially build up inside piston 25, piston chamber 26 and connecting chamber 27 to push piston 25, rod 21 and guide 22 to the right and seal the end of barrel 12. The operation of on/off switch 18 provides electrical power to a motor 35 (FIGS. 9 and 12) that drives a mechanical mechanism that times a predetermined period at the end of which pressurized air inside piston 25, piston chamber 26 and connecting chamber 27 is vented to the rear of apparatus 10. This creates the previously described vacuum which causes piston 25 and rod 21 to move to the left pulling guide 22 along with it. The nose of guide 22 with O-ring 23 thereon is retracted from the inside of cylindrical protrusion 24 and the pressurized air inside main body 11*b* and barrel 12 is released at opening 20 at the end of barrel 12 to launch a football 31 mounted on the end of the barrel 12.

In FIG. 7 guide 22 is shown just outside of cylindrical protrusion 24 as it moves to the left and this opens barrel end opening 20. Guide 22 has a plurality of fluted sections 22*a* through which the pressurized air stored inside chamber 11*b* and barrel 12 passes on its way out of barrel end opening 20. This pressurized air exiting barrel 12 causes a football 31 mounted on barrel 12 to be thrown/launched off the end of barrel 12. At the same time football 31 is propelled in a spiral manner as previously described with reference to spiral grooves 12*a* on the outer surface of barrel 12 and with reference to FIG. 10.

After football 31 is launched off the end of barrel 12, pressurized air being inserted into main body 11*a* via Schrader valve 17 will not build up air pressure again due to pressure release elements 32 *a,b,x* causing air inside barrel 12 to be vented out of hole 32*y* as shown in and described in greater detail with reference to FIG. 11A. After a football 31 is again mounted on the end of barrel 12, the interior wall of the cavity 34 in the rear end of football 31 (FIG. 10) presses against flat spring metal piece 32*x* to thereby press T shaped element 32*a*, 32*b* into hole 32*y* to seal hole 32*y* and thereby cause air pressure to again build up inside chamber 11*b* and barrel 12.

Figure 8:
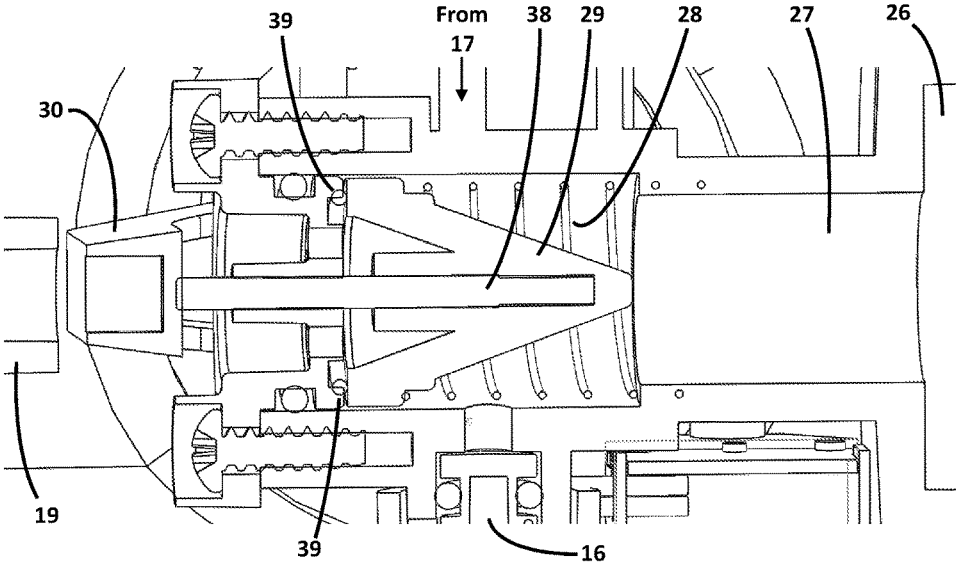
FIG. 8 is a side cutaway, blow up view of the main body at the rear of the football throwing apparatus.

FIG. 8 is a side cutaway view of the main body 11*a* of football throwing apparatus 10. At the far right of this figure is shown piston chamber 26 in which the previously described piston 25 moves back and forth under the influence of the aforementioned launching vacuum and air pressure build up as shown and described with reference to FIGS. 6 A&B. At the left or rear end of piston chamber 26 is connecting chamber 27. As previously described, air pressure builds up inside piston 25, piston chamber 26 and connecting chamber 27 and is then rapidly vented to create the previously described vacuum which pulls piston 25 (not shown) to the left which initiates the previously described operation and causes football 31 on the end of barrel 12 to be launched.

To the left of connecting chamber 27 is a conical shaped member 29 which is mounted on a short rod 38. Mounted in front of member 29 is a coiled spring 28 the left end of which sits against member 29 and spring pressure keeps member 29 as far to the left as it can travel until the operator of apparatus 10 either depresses button 19 on the rear of main body 11*a* or operates ON switch 18 on top of main body 11*a* to launch a football 31.

Mounted on the bottom edge (left side in FIG. 8) of conical shaped member 29 is an O-ring 39. O-ring 39 rests against a portion of the housing of main body 11*a* as shown to create an airtight seal as spring 28 compresses O-ring 39 between the bottom edge of member 29 and the plastic housing of main body 11*a*. With the existence of this seal air pressure can build up inside connecting chamber 27 piston chamber 26 in the inside of piston 25, and in chamber 11*b* and barrel 12.

Rod 38 extends to the left from member 29 as shown in FIG. 8. Actuating arm 30 is very close to or is in contact with the left end of rod 38. There is a vertical pin 40, not shown in FIG. 8 but shown in and described with reference to FIG. 9, which is to the rear of what is shown of actuating arm 30 in FIG. 8, and about which actuating arm 30 rotates. Actuating arm 30 is pushed to the right by either manual release button 19, or by a rotating arm 43 (not shown in FIG. 8) that is shown in and described with reference to FIG. 9. When release button 19 on the rear of main body 11*a* is manually pushed end 30*a* (FIG. 9) of arm 30 presses against the left end of actuating rod 38 which, in turn, pushes conical shaped member 29 to the right against the pressure of its coil spring 28. This breaks the air seal created by the O-ring 39 on the base of member 29. Compressed air stored in the area of spring 28, connecting chamber 27, piston chamber 26 and in the base of piston 25 rapidly escapes to the left and creates the previously described vacuum that results in pulling piston 25, rod 21 and guide 22 to the rear of football launching apparatus 10 to launch a football 31 off of barrel 12. This football launching operation is aided by the pressurized air stored in chamber 11*b* and barrel 12 as previously described.

At the bottom of FIG. 8 is shown air pressure control 16. As previously described, when the air pressure inside main body 11*a* and the rest of apparatus 10 exceeds a pressure predetermined by the setting of air pressure control 16, control 16 pushes against its spring and opens to prevent any further increase in air pressure by venting pressurized air.

At the top of FIG. 8 is an input channel having an incoming arrow and marked "From 17" where element 17 is the Schrader valve by which pressurized air is input to apparatus 10. The pressurized air may be from a hand pump or from an electrical air pump.

Figure 9:
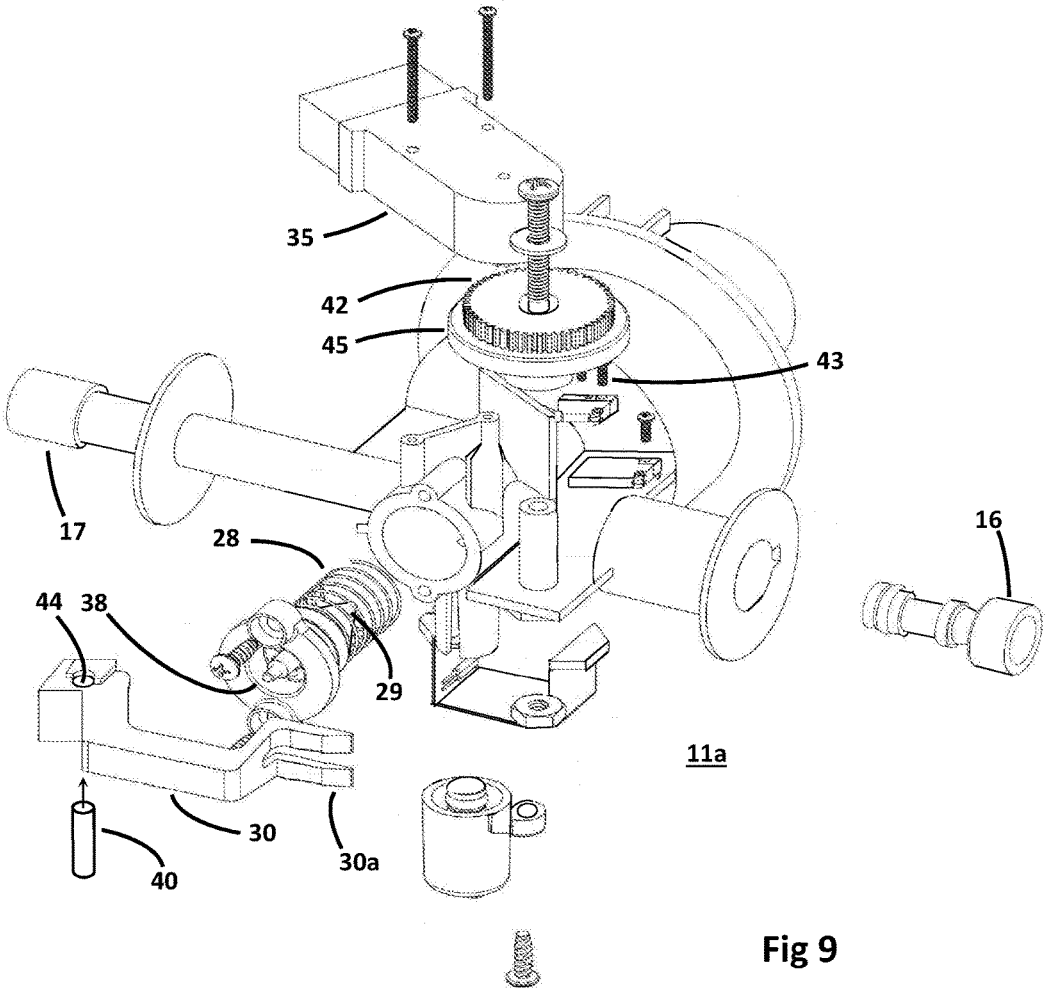
FIG. 9 is an exploded view of the parts in the interior of the main body at the rear of the football throwing apparatus.

In FIG. 9 is an exploded view of various parts in the interior of main body 11*a* that complements what is shown in FIG. 8. Schrader valve 17 and pressure release valve 16 are shown. They are connected to opposite sides of main body 11*a*. Continuing from the description of FIG. 8, shown is conical shaped member 29 with its coil spring 28 that forces member 29 to the rear toward actuating arm 30. Actuating arm 30 has a hole 44 and is mounted on and rotates about a fixed pin 40. As previously described with reference to FIG. 8, for the immediate football launch mode, release button 19 (not shown in FIG. 9) is pushed and it pushes arm 30 toward member 29 which, in turn, pushes against the end of actuating rod 38 which is connected to conical shaped member 29 to break the airtight seal and cause the launch of football 31 as previously described with reference to FIG. 8.

in FIG. 9 element 35 is an electric motor having at its output a small cog wheel. This small cog wheel meshes against a larger cog wheel 42 which is mounted on a circular plate 45. Due to the difference in the diameters of the small cog wheel and the larger cog wheel 42, the small cog wheel rotates many times before cog wheel 42 makes one full revolution. When the operator of the football throwing apparatus utilizes the timed football throw mode they actuate the manual on/off switch 18 on top of main body 11*a* (see FIGS. 1-6 and 11). As shown in and described with reference to the schematic diagram shown in FIG. 11 the actuation of switch 18 causes motor 35 to operate.

Figure 10:
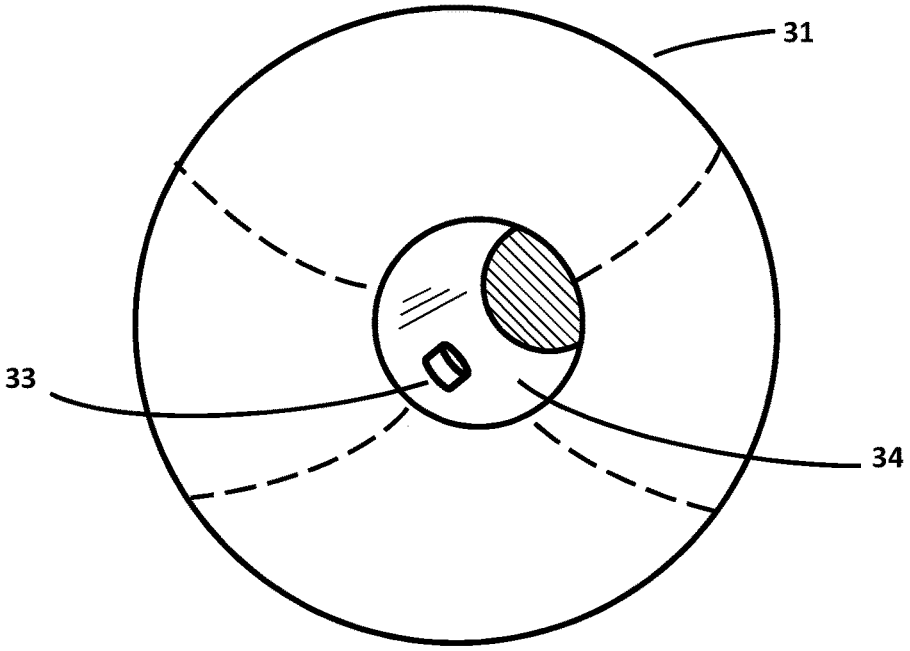
FIG. 10 is a rear view of a football showing a cavity in the rear end of the ball that is mounted on the barrel of the football throwing apparatus, and in the cavity are positioned protrusions utilized in imparting a spin to the football as it is launched/thrown off the end of the barrel.
Figure 11A:
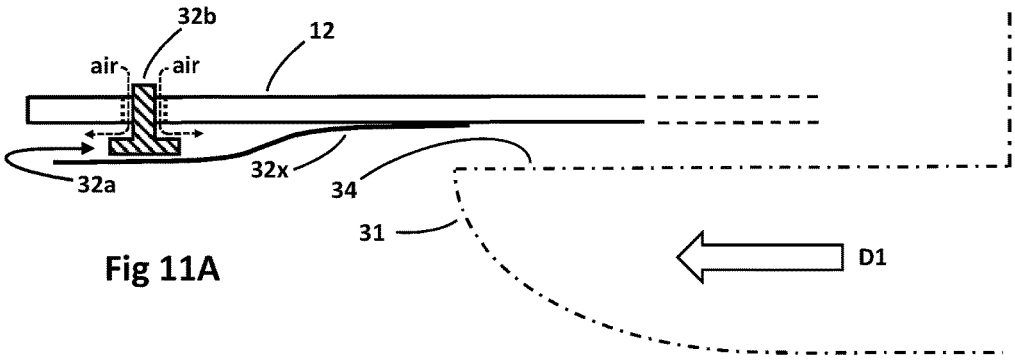
FIGS. 11A, 11B and 11C show the safety mechanism that prevents the launch of anything other than the provided football from the football throwing apparatus.
Figure 11B:
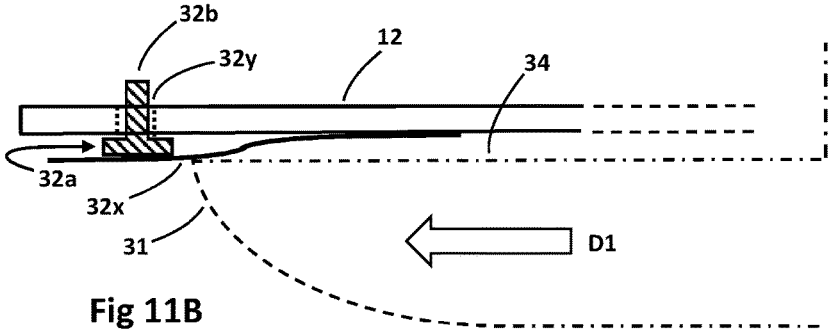
Figure 11C:
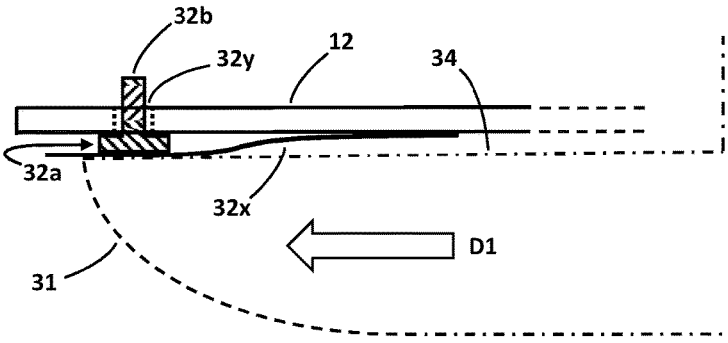

Over the course of some number of seconds larger cog wheel 42 makes one revolution. At the same time circular plate 45 also makes one revolution. Extending from the bottom of plate 45 is a pin 43. Pin 43 initially sits adjacent to tapered legs 30*a* of actuating arm 30. As circular plate 45 makes one revolution, at the end of the one revolution pin 43 contacts the tapered outer end 30*a* of actuating arm 30 and presses upon it. This rotates actuating arm 30 a small amount about its pin 40 and causes actuating arm 30 to depress actuating rod 38. In FIG. 9 manually operated button 19 is not shown for simplicity, but it would be located roughly where the left end of the lead line is for element number 30. When pushed button 19 pushes arm 30 into rod 38 and thereby triggers the launch of football 31 in the manner previously described. This is shown better in FIGS. 6A&B and 8. In the side view shown in FIG. 8 actuating arm 30 is in a position very close to the left end of short rod 38 which, in turn, is fastened to the large base of conical shaped member 29. The base of button 19 (see FIG. 5) is very close to actuating arm 30 and when button 19 is manually depressed it pushes actuating arm 30 to the right which, in turn, manually pushes rod 38 and conical member 29 to the right to the right to cause the throwing of a football 31 as is described in detail elsewhere herein. As previously described with reference to FIG. 8, member 29 has an O-ring seal 39 on its base which creates an air-tight seal preventing compressed air being input at Schrader valve 17 from escaping until football throwing apparatus 10 is activated as just described to throw a football. The activation is either manual by pressing button 19, or after a timed period by operating switch 18 as described with reference to FIG. 9. As previously described with reference to FIG. 8 this vents the compressed air around spring 28 and in connecting chamber 27, piston chamber 26 and in the base of piston 25 to the rear. This creates the vacuum which pulls piston 25, rod 21 and guide 22 to the left to open the air seal at the end of barrel 12 and thereby launch/throw a football 31 mounted on barrel 12. This operation is aided by the air pressure in chamber 11*b* and in barrel 12.

in FIG. 10 is shown a rear end view of a football 31 with a coaxial hole 34 in the base thereof. When mounting football 31 to barrel 12 the end of barrel 31 is inserted into coaxial hole 34 as shown in FIG. 2. As previously described with reference to FIGS. 1-4, there is a helical groove 12*a* around the outside and along most of the length of barrel 12. When mounting football 31 is mounted on barrel 12 a projection 33 extending from the inside wall of hole 34 rides in and along the groove 12*a*. As previously mentioned the mounting of football 31 on barrel 12 causes the barrel 12 to be sealed by elements 32 *a,b,x*, which are shown in and described in detail with reference to FIG. 11. Air pressure is then built up inside football throwing apparatus 10 as shown in and described with reference to FIG. 6 and other Figures.

in FIG. 11 A,B,C are shown safety mechanism seal elements 32 *a,b,x* that cooperate to prevent compressed air steward inside football launching apparatus 10 from escaping through hole 32*y* through the wall of barrel 12 when a football 31 is mounted on the barrel. In FIGS. 11A-11C a small portion of the bottom wall of barrel 12 is shown. Through the wall of barrel 12 there is a hole 32*y* (identified in FIGS. 11B and 11C). Mounted in hole 32*y* is a "T" shaped member 32*a,b* that has a shaft 32*b* that is inserted through hole 32*y* as shown, and a T-shaped circular head 32*a*. There is space between the shaft 32*b* and the wall of hole 32*y* through which compressed air inside barrel 12 escapes to prevent air pressure from building up inside chamber 11*b* and barrel 12 when there is no football 31 mounted on barrel 12. There is also a flat strip of spring metal 32*x* that is attached to barrel 12 and it has a portion that sits over the T-shaped circular head 32*a* of member 32*a,b* and retains T-shaped member 32*a,b* inside hole 32*y* under the flat strip of spring metal 32*x*.

There is space between the edges of the small hole 32*y* and the leg 32*b* of the "T" shaped element 32 *a,b*. When there is no football 31 mounted on barrel 12 any air pressure inside the barrel 12 pushes the round head of the "T" shaped element away from the outside wall of barrel 12 and thereby vents pressurized air through hole 32*y*. This prevents air pressure from building up inside barrel 12, main body 11*a* and air pressure chamber 11*b*. When a football 31 is mounted on barrel 12, as shown in FIG. 2, the inside wall of cylindrical channel 34 in the base of football 31 (see FIG. 10) presses against the flexible element 32*x* and this thereby presses against head 32*a* to causes the "T" shaped element 32*a,b* to seal the vent hole 32*y* through the sidewall of barrel 12 as shown. A rubber seal (not shown) may be provided around the leg 32*b* of "T" shaped element 32*a,b* and is mounted under the wider head 32*a* thereof to assist in establishing the air seal. Pressurized air being input via Schrader valve 17 may then build up inside football throwing apparatus 10 as previously described. Safety is provided because other items, other than special football 31, may be placed on the end of barrel 12 but they will not permit air pressure to build up inside chamber 11*b* and barrel 12, and used to launch the other items. This safety mechanism protects against misuse of the football throwing apparatus 10.

Figure 12:
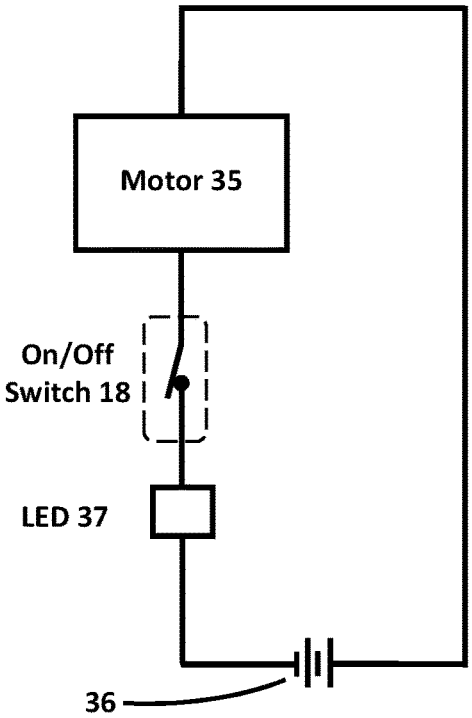
FIG. 12 is a block schematic diagram of the circuitry used to power the football throwing apparatus where in one mode of operation the football is launched immediately on depressing a first button, and in a second mode where there is a time delay between depressing a second button and initiating the launch of the football, the time delay being created by an electrical motor.

In FIG. 12 is shown a block diagram schematic of the circuitry used to power football throwing apparatus 10 in one mode of operation where there is a time delay between manually initiating a launch/throw of the football 31 by turning on switch 18 and the delayed time after which the football is actually launched/thrown. As previously described, to initiate this mode of operation an operator operates on/off switch 18 which, as may be seen in FIG. 12, closes a circuit including battery 36, motor 35 and LED 37. Motor 35 is actuated and creates the timing period as described with reference to FIG. 9, by rotating gear wheel 45 and at the end of which time period football 31 is launched/thrown. While switch 18 is operated LED 37 remains lit as a reminder to the operator to turn switch 18 OFF after the football is thrown/launched.

While what has been described herein is the preferred embodiment of the invention it will be understood by those skilled in the art that numerous changes may be made without departing from the spirit and scope of the invention. For example, there need not be a separate air pressure chamber 11*b* behind barrel 12. There can just be a larger barrel 12. The grooves 12*a* may be eliminated if it is not desired to provide a spiral spin to a ball being thrown by apparatus 10. In addition, a variable football launch timing may be utilized.

The invention claimed is:

1. A football throwing apparatus having a source of compressed air, the football throwing apparatus comprising:

a first enclosed chamber in which the compressed air is stored;

a second enclosed chamber in which the compressed air is also stored, the second enclosed chamber including a hollow barrel having a launching end on which a football is positioned to be thrown;

a piston slidably mounted in the first enclosed chamber;

a connecting rod having a first end and a second end and the first end is connected to the piston; and a first seal connected to the second end of the connecting rod, and the first seal is adjacent to the throwing end of the barrel;

wherein when the football throwing apparatus is being charged with compressed air from the external source of compressed air the compressed air causes the piston to slide toward the throwing end of the barrel and this moves the first seal connected to the piston via the connecting rod to close the throwing end of the barrel and store the compressed air inside the first enclosed chamber and the second enclosed chamber;

wherein when the football throwing apparatus is initiated to throw the football positioned on the throwing end of the barrel, the compressed air stored in the first enclosed chamber is vented from the first enclosed chamber which creates a vacuum that causes the piston and first seal attached thereto via the connecting rod to slide toward the first enclosed chamber and thereby move the first seal to open the throwing end of the barrel, and the compressed air stored in the second enclosed chamber is thereby released out the now opened throwing end of the barrel to throw the football positioned on the throwing end of the barrel;

a second seal that seals the first enclosed chamber opening when compressed air is to be stored in the first enclosed chamber and stored in the second enclosed chamber in preparation for throwing a football off the throwing end of the barrel; and wherein the barrel is hollow and has a wall and through the wall of the barrel is a hole, and further comprising: a third seal mounted in the barrel hole, the third seal being in a first position that causes any air input to the second enclosed chamber including its hollow barrel to be vented to outside the football throwing apparatus and thereby prevent any buildup of compressed air in the football throwing apparatus, and the third seal is in a second position that seals the barrel hole and is held in that position only when a football is mounted on the barrel, and when the third seal is in its second position any compressed air input to the first enclosed chamber and to the second enclosed chamber with its hollow barrel is stored therein.

2. The football throwing apparatus of claim 1 wherein the piston has a hollow base facing toward the first enclosed chamber, the piston hollow base has a wall with a small hole there through, the small hole is closed when the piston is closest to the first enclosed chamber, and the small hole is open when the piston is closest to the second enclosed chamber, and when the piston is closest to the second enclosed chamber compressed air input into the first enclosed chamber passes through the small hole into the second enclosed chamber.

3. The football throwing apparatus of claim 2 wherein the first enclosed chamber has an opening for venting compressed air stored in the first enclosed chamber to create the vacuum that causes the piston and the first seal connected thereto via the connecting rod to move toward the first enclosed chamber.

4. The football throwing apparatus of claim 3 further comprising a first throwing control and a second throwing control, wherein the second seal unseals the first enclosed chamber immediately upon manually depressing the first throwing control, and the second seal unseals the first enclosed chamber opening after a predetermined time delay after operating the second throwing control.

5. The football throwing apparatus of claim 4 further comprising an adjustable air pressure control that is used to set the maximum air pressure of the compressed air stored in the first enclosed chamber and in the second enclosed chamber which includes the barrel which is part of the second enclosed chamber.

6. The football throwing apparatus of claim 1 wherein the first enclosed chamber has an opening for venting compressed air stored in the first enclosed chamber to create the vacuum that causes the piston and the first seal connected thereto via the connecting rod to move toward the first enclosed chamber; and further comprising a second seal that seals the first enclosed chamber opening when compressed air is to be stored in the first enclosed chamber and in the second enclosed chamber in preparation for throwing the football off the throwing end of the barrel.

7. The football throwing apparatus of claim 6 further comprising a first throwing control and a second throwing control, wherein the second seal unseals the first enclosed chamber immediately upon manually depressing the first throwing control, and the second throwing control unseals the first enclosed chamber opening a predetermined time delay after operating the second throwing control.

8. The football throwing apparatus of claim 7 further comprising an adjustable air pressure control that is used to set the maximum air pressure of the compressed air stored in the first enclosed chamber and in the second enclosed chamber which includes the barrel which is part of the second enclosed chamber.

9. The football throwing apparatus of claim 1 further comprising an adjustable air pressure control that is used to set the maximum air pressure of the compressed air stored in the first enclosed chamber and in the second enclosed chamber which includes the barrel which is part of the second enclosed chamber.

10. A football throwing apparatus having a source of compressed air, the football throwing apparatus comprising:

a first enclosed chamber in which the compressed air is stored; and a second enclosed chamber in which the compressed air is also stored, the second enclosed chamber including a barrel having a throwing end on which a football is positioned to be thrown;

wherein when the football throwing apparatus is initiated to throw a football positioned on the throwing end of the barrel, the compressed air stored in the first enclosed chamber is vented from the first enclosed chamber to outside of football throwing apparatus which creates a vacuum that causes the compressed air stored in the second enclosed chamber to be released out of the throwing end of the barrel to throw the football positioned on the throwing end of the barrel;

wherein the first enclosed chamber has a first opening for venting compressed air stored in the first enclosed chamber to create the vacuum that causes the throwing of the football mounted on the throwing end of the barrel; and further comprising a first seal that seals the first enclosed chamber opening when compressed air is to be stored in the first enclosed chamber and in the second enclosed chamber in preparation for throwing the football off the throwing end of the barrel; and wherein the barrel is hollow and has a wall and through the wall of the barrel is a hole, and further comprising: a second seal mounted in the barrel hole, the second seal being in a first position that causes any air input to the second enclosed chamber including its hollow barrel to be vented to outside of football throwing apparatus and thereby prevent any buildup of compressed air in the football throwing apparatus, and the second seal is in a second position that seals the barrel hole and is held in that position only when a football is mounted on the barrel, and when the second seal is in its second position any compressed air input to the first enclosed chamber and the second enclosed chamber with its hollow barrel is stored therein.

11. The football throwing apparatus of claim 10 further comprising a first throwing control and a second throwing control, wherein the first seal unseals the first enclosed chamber either immediately upon manually operating the first throwing control, or after a predetermined time delay after operating the second throwing control.

12. The football throwing apparatus of claim 11 further comprising a manually adjustable air pressure control that is used to set the maximum air pressure of the compressed air stored in the first enclosed chamber and in the secondary enclosed chamber.

13. The football throwing apparatus of claim 10 further comprising an adjustable air pressure control that is used to set the maximum air pressure of the compressed air stored in the first enclosed chamber and in the second enclosed chamber which includes the barrel that is part of the second enclosed chamber.

14. The football throwing apparatus of claim 13 wherein the barrel is hollow and has a wall and through the wall of the barrel is a hole, and further comprising:

a second seal mounted in the barrel hole, the second seal being in a first position that causes any air input to the second enclosed chamber including its hollow barrel to be vented to outside the football throwing apparatus and thereby prevent any buildup of compressed air in the football throwing apparatus, and the second seal is in a second position and is held in that second position only when a football is mounted on the barrel, and when the second seal is in its second position any compressed air input to the first enclosed chamber and the second enclosed chamber with its hollow barrel is stored therein.

15. The football throwing apparatus of claim 10 further comprising an elongated means extending between the first enclosed chamber and the throwing end of the barrel of the second enclosed chamber, the elongated means has a first seal at one end that seals the throwing end of the barrel to permit compressed air to be stored in the first enclosed chamber and in the second enclosed chamber, and when the compressed air in the first enclosed chamber is vented to outside the football throwing apparatus the vacuum created thereby moves the elongated means toward the first enclosed chamber which withdraws the first seal at the one end of the elongated means from the throwing end of the barrel to launch the football.

16. The football throwing apparatus of claim 10 further comprising an elongated means extending between the first enclosed chamber and the throwing end of the barrel of the second enclosed chamber, the elongated means has a third seal at one end that seals the throwing end of the barrel to permit compressed air to be stored in the first enclosed chamber and in the second enclosed chamber, and when the compressed air in the first enclosed chamber is vented to outside the football throwing apparatus the vacuum created thereby moves the elongated means toward the first enclosed chamber which withdraws the third seal at the one end of the elongated means from the throwing end of the barrel to launch the football.

* * * * *